United States Patent [19]

Von Der Mark

[11] Patent Number: 4,968,036

[45] Date of Patent: Nov. 6, 1990

[54] ICE HOCKEY PUCK

[76] Inventor: Eberhard Von Der Mark, Oberhombrechen 10, 5609 Hückeswagen, Fed. Rep. of Germany

[21] Appl. No.: 171,876

[22] PCT Filed: Jun. 26, 1987

[86] PCT No.: PCT/EP87/00348

§ 371 Date: Apr. 27, 1988

§ 102(e) Date: Apr. 27, 1988

[87] PCT Pub. No.: WO88/00075

PCT Pub. Date: Jan. 14, 1988

[30] Foreign Application Priority Data

Jul. 2, 1986 [DE] Fed. Rep. of Germany ... 8617599[U]

[51] Int. Cl.[5] ..... A63B 67/00

[52] U.S. Cl. ..... 273/128 R

[58] Field of Search ..... 273/128 R, 126 R, 128 CS, 273/128 A, 58 F, DIG. 24, 58 G; 446/47, 219, 236, 242, 245, 247, 248, 156

[56] References Cited

U.S. PATENT DOCUMENTS

| | | | |
|---|---|---|---|
| 2,020,484 | 11/1935 | Turner | 273/58 G |
| 3,102,727 | 9/1963 | Rice | 273/128 R |
| 3,117,788 | 1/1964 | Buonanno et al. | 273/128 R |
| 4,183,536 | 1/1980 | Platt | 273/128 R |

FOREIGN PATENT DOCUMENTS

| | | | |
|---|---|---|---|
| 848825 | 5/1967 | Canada | 273/58 G |

*Primary Examiner*—Theatrice Brown

*Attorney, Agent, or Firm*—Saidman, Sterne, Kessler & Goldstein

[57] ABSTRACT

The puck is provided in its center with a recess (2) to receive at least one light source (3), and light channels (7) are arranged leading from this light source (3) to its circumscribing surface (4) and/or to the edges of its two lateral surface (5, 6), said channels being filled with a highly transparent material.

8 Claims, 4 Drawing Sheets

ICE HOCKEY PUCK

The invention is directed to an ice hockey puck with a flat cylindrical body made of rubber-elastic material.

The known ice hockey pucks have the disadvantage, due to their small size and the high speed with which they slide over the playing field, that they are often difficult to see by spectators and players alike. It is often not possible for spectators to follow the play, especially in poor lighting conditions and in film and television transmissions, because the ice hockey puck is not, or is only very insufficiently visible.

An object of the present invention is to provide an ice hockey puck that is easier to see by players as well as spectators.

This object is achieved by the present invention with a puck that is provided in its centre with a recess to receive at least one light source, and light channels are arranged leading from this light source to its circumscribing surface and/or to the edges of its two lateral sufaces, the channels being filled with a highly transparent material. These light channels, running crossways or diagonally through the body of the puck, make it possible for the light source, or for the light emitted from the light channels, to be visible by the players and the spectators in every position of the puck.

To ensure that the dynamic behaviour of the ice hockey puck is not changed by the arrangement of the light channels, they are filled with a highly transparent rubber-elastic material whose elasticity or hardness is substantially equivalent to the elasticity or hardness, respectively, of the rest of the hard-rubber body of the puck.

The walls of the light channels, or the transparent material filling them, are provided with a mirroring fully reflective layer to provide better light intensity. The transparent filling in the light channels can also be coloured, so that the puck gives off a yellow, red or blue light.

The light source, together with the energy source, may be secured to one of the cover plates of the central cavity, the edge of the plate being clamped, glued or welded in place. But the light source, together with the energy source and electrical or electronic switching or control arrangement may also be in one of the cavities filled with the rubber-elastic material. This rubber elastic plug may be interchangeably placed into the puck. The energy source may be magnetically turned on and off for example by a reed switch. Suitable light sources are light-emitting diodes that are insensative to shock.

Figure 9:
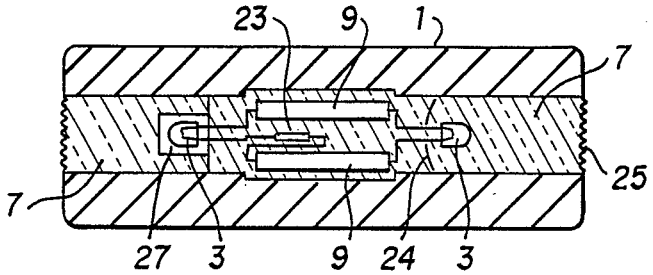

The should be at least two light channels running out from the middle in opposite directions towards the circumscribing surface. FIG. 9 in this case, the two light channels and the central cavity receiving the light source may be formed from a single, cylindrical cavity wherein the transparent material, the energy source and the electrical or electronic switching and control arrangement are embedded, forming a cylindrical body that may be press-fitted into the cylindrical cavity of the puck from one side of the puck.

To achieve maximum brightness with minimum energy use, it is advantageous to have the energy supplied to the light source in a pulsing manner, for example at a frequency of 5 Hertz. This pulsing light is especially easy to see. The pulsing energy source is composed of a battery and integrated circuits or an electrical switch, which convert the direct current supplied by the battery into a pulsing current of higher voltage.

It may also be advantageous to have not only one light source in the centre of the puck but multiple light sources, whereby each light channel is arranged with a light source, particularly a light emitting diode.

To better utilize the light source, the material filling the light channels may be formed into a body which includes a cavity in which the light source is set. Further behind each light source a reflector may be provided. In addition, the walls of the light channels or of the material filling the light channels, except for the light entry and emitting surfaces, may be covered with a luminous reflecting layer, so that, in addition to the light from the light source, the light reflected by this layer also shines out. The light emitting surface of the material filling the light channels may also have a light diffusing profile, so that the light shines in all directions in a diffuse fashion.

The object of the invention may also be solved in that the body of the ice hockey puck, in the area near its lateral surfaces or circumscribing surface consists at least partially of a highly transparent or clear glass-like material under which light reflectors are arranged. A puck constructed in this fashion has itself no light source, rather it reflects the light of the floodlights shining onto the playing field.

Finally, it is also possible to arrange light guiding fibers and light guiding bundles in the body of the ice hockey puck, whose light entry surfaces are parallel to the lateral surfaces of the body and whose end surfaces are parallel to the circumscribing surface of the body. The light guiding fibers guide the light which falls onto the upper lateral surface of the puck to the circumscribing surface, so that bright dots appear spread out on the circumference.

It is also possible to increase the visibility of the ice hockey puck by arranging in it at least one light source with light channels running therefrom, as well as reflectors which reflect the light which shines onto the puck.

Further particulars of the intention arise out of the claims.

Figure 1:
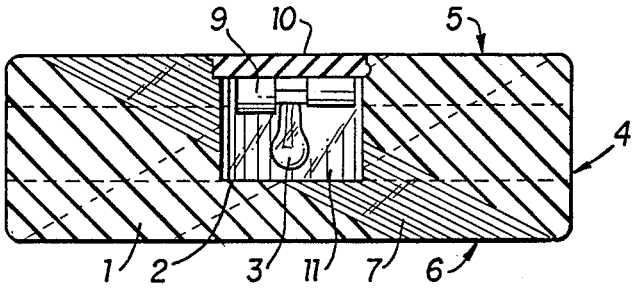
Figure 2:
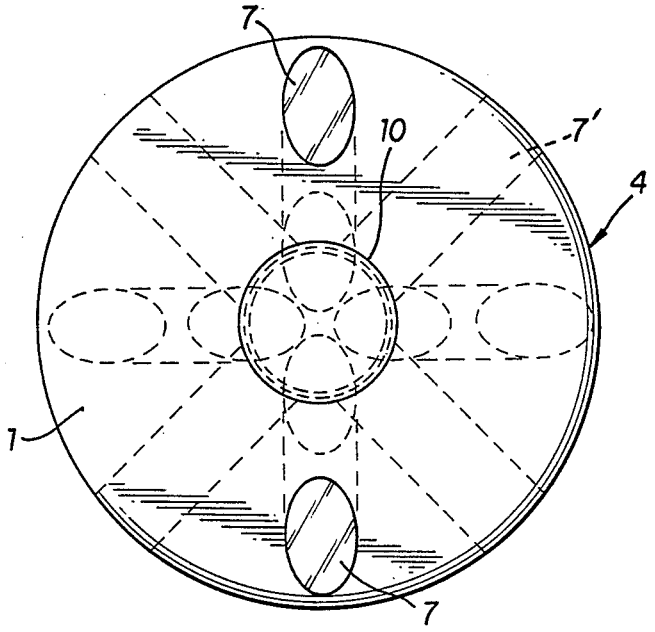

In the following description, four embodiments are further illustrated by reference to the drawings. The drawings show in:

FIG. 1 a sectional view,

FIG. 2 a plan view and

Figure 3:
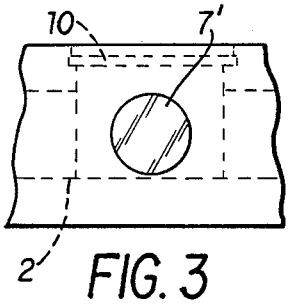
Figure 4:
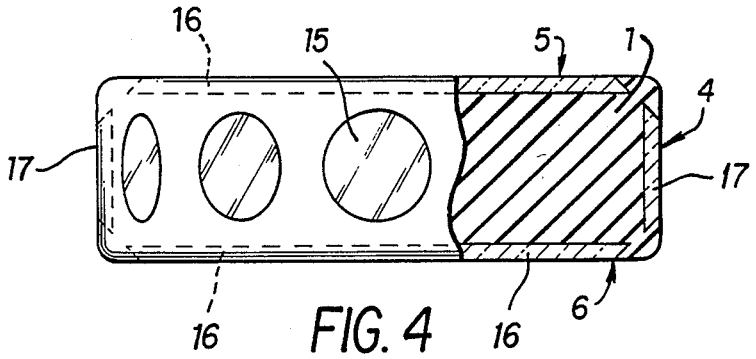
Figure 5:
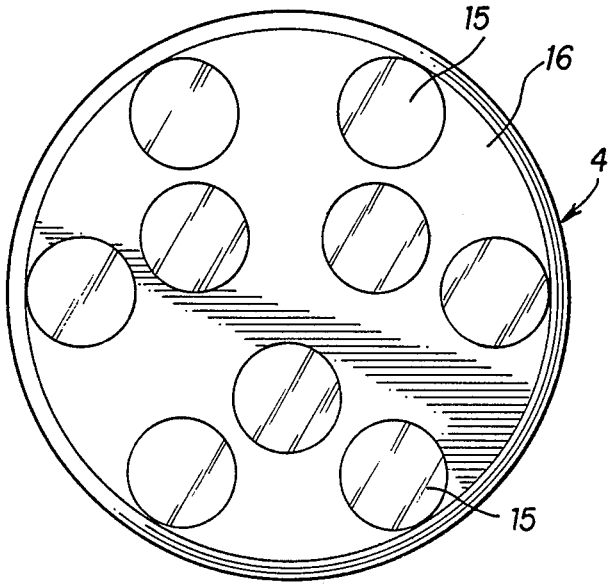
Figure 6:
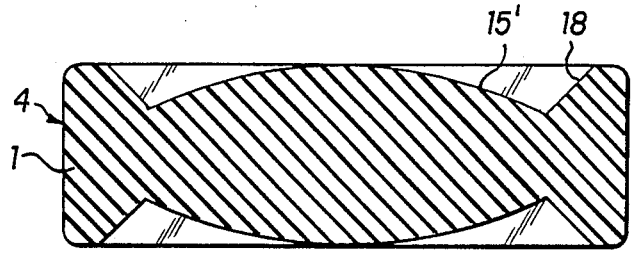
Figure 7:
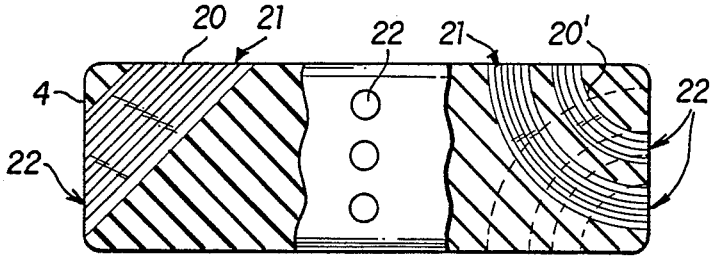
Figure 8:
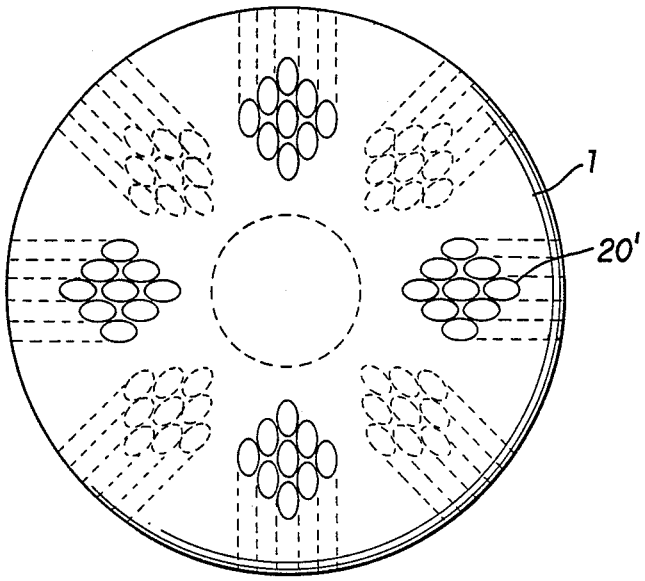
Figure 10:
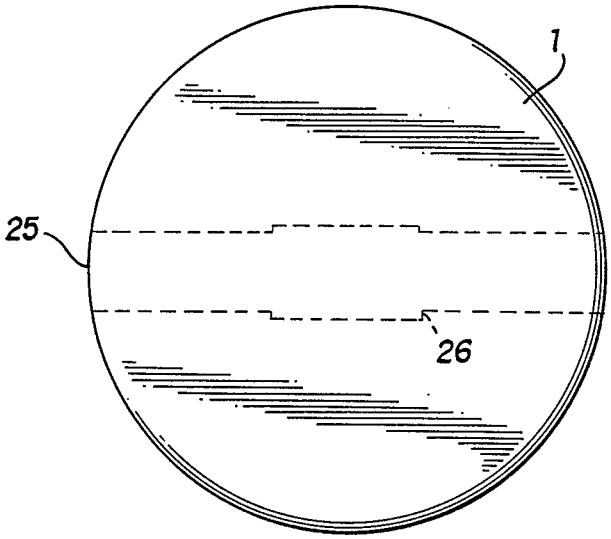
Figure 11:
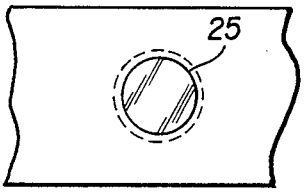

FIG. 3 a partial view of the ice hockey puck provided with a light source according to the invention, FIG. 4 a side view, partially a sectional view, FIG. 5 a plan view of an ice hockey puck provided with reflectors, FIG. 6 a sectional view with reflectors arranged on the circumscribing surface, FIG. 7 a sectional view and FIG. 8 a plan view of an ice hockey puck provided with light guiding fibers, FIG. 9 a sectional view, FIG. 10 a plan view and FIG. 11 a partial view of another embodiment of the ice hockey puck according to the invention.

As FIGS. 1 to 3 show, the ice hockey puck possesses a flat cylindrical body 1 of rubber-elastic material, in particular, hard-rubber. In its middle, a cavity 2 is provided to receive a light source 3, the light from which is guided through light channels 7 to the (edges of both lateral surfaces 5 and 6) and/or to the circumscribing surface 4 of the body 1. In the ice hockey puck according to FIG. 1 and FIG. 2, four diagonally running light channels 7 are provided, and two light channels 7' crossing in the middle of the puck, whose emitting surfaces lie on the circumscribing surface 4.

The light channels 7 and 7' are filled with a clear glass-like highly transparent rubber-elastic material, whose material properties correspond to that of the body 1, so that the ice hockey puck behaves when struck as if it was composed of one homogeneous hard-rubber body.

The highly transparent rubber-elastic material is preferably a light-collecting and light-guiding Polymer based on Polymethylmethacrylate (PMMA). The light source 3 may, in particular, be formed of one or more light emitting diodes. These discrete light emitting diodes are shock resistant and give a high brightness with minimal power use. The light source, together with an energy source, in particular a 1.5 Volt battery, may be fastened to the cavity 2 closing plate 10. The edge of this closing plate 10 may be press-fitted or glued into place. The light source 3 may also be arranged, together with the energy source 9 and the electrical or electronic switching or control arrangement, in one of the cavity 2 filling rubber-elastic plugs. This unit is easily replaceable by means of a straddle arrangement 12, in the cavity 2 of the body 1. The light source may be connected to the power source through a reed switch. The reed switch may be switched with a magnet. Also a switch may be provided, which is turned on by means of a shock and stays on until the energy source is exhausted.

To save energy, the energy source may be connected to a pulse generator which supplies the light source with short, quick bursts of power.

The plate 10, the energy source 9, the switch and control pieces as well as the light source 3 are integrated within an exchangeable plug of clear elastic material. The plate 10 may be constructed so that it has a bulge which snaps into a ring-shaped recess when the plug 11 is set. In the plate 10 and/or in the rubber-elastic plug 11 clamp means may be provided which would cause the plug 11 or the plate 10 to be removably attached to the body 1 of the ice hockey puck. It is also possible to provide a two component chemical light source which gives off a cold light over several hours when the two chemical components are brought together, for example, by breaking a small tube.

In the embodiment according to FIG. 4 and 5, the body 1 of the ice hockey puck in the region of its lateral surfaces 5 and 6 and/or its circumscribing surface 4 consists, at least partially, of a highly transparent clear glass-like material under which light reflectors 15 are arranged. These reflectors 15 reflect the light which shines on them from the lights illuminating the playing field. To this end, the upper surface of these reflectors 15 are curved outwards so that a portion of the playing field lighting is constantly reflected to be visible by each spectator.

The reflectors, in the shape of circular surfaces, may be arranged on the lateral surfaces 4 and 5 of the ice hockey puck and/or on the circumscribing surface 4.

In the embodiment of FIG. 6, large reflectors 15' are provided only on both lateral surfaces, which reflectors fit into an outer conical reflector ring 18.

In the embodiments according to FIG. 7 and FIG. 8, light guiding bundles 20, 20' are arranged in the body 1 of the ice hockey puck so that the entry surfaces 21 of the light guiding bundles 20 run parallel to the lateral surfaces 4 and 5 of the ice hockey puck, while the end surfaces 22 run parallel to the circumscribing surface 4. With the aid of this light guiding bundle 20, the light which shines on the upper side of the ice hockey puck is redirected to the circumscribing surface 4.

In the embodiment according to FIG. 9 to 11, the light source 3, the energy source 9, the electrical or electronic switching or control arrangement 23 and the material filling the light channels 7 are combined into a subassembly and fitted directly into the body 1 of the puck.

To form the subassembly, two alternatives are presented in FIG. 9. On the right-hand side, the highly transparent material filling the light channels 7 is poured over all elements assembled in the channels. In this case, a reflector 24 is arranged behind the light source to reflect the rearward shining light. The entire subassembly, except for the light emitting surfaces 25, is covered with a reflecting or fluorescent layer.

On the left-hand side, the energy source 9 and the electrical or electronic switching or control arrangement 23 are encased in synthetic material, out of which the light source 3 protrudes. This subassembly is secured to the body 7 of highly transparent material, which has a cavity 26 for receiving the light source 3, by means of a pressure-fit. These bodies are provided with a reflecting or fluorescent layer 25, except at the surfaces of light entry and emission. The light emitting surface 25 is covered with pyramid-shaped or lens-shaped projections.

The subassembly forms in essence a cylindrical body with a somewhat larger diameter in its middle region. This body may be pressure-fitted into the bore in the puck body 1. Because of the cut-out 26 of a larger diameter in the middle region, a tighter fit is possible.

List of Reference Numbers

1 Body
2 Recess
3 Light source
4 Circumscribing surface
5 Lateral surface
6 Lateral surface
7 Light channel
8 Light guiding fibers
9 Energy source
10 Plate
11 Plug
15 Light reflector
15' Light reflector
16 Cover plate
17 Outer cover
18 Reflector ring
20 Light guiding bundle
21 Entry surface
22 End surface
23 Electrical switching and control arrangement
24 Reflector
25 Light emitting surface
26 Cut-out
27 Cavity

I claim:

1. An ice hockey puck having a flat cylindrical body of rubber-elastic material in the middle of which a recess is provided for receiving an energizing source which cooperates with at least a light source, the light of which exits at the periphery of said ice hockey puck, said recess also houses said light source and light-guiding channels of highly transparent material are provided between said light source and said periphery of said ice hockey puck, and that the elasticity or hardness of the highly transparent material is substantially similar to the elasticity or hardness of the remainder of said body.

2. An ice hockey puck according to claim 1, characterized in that the light source comprises one or more light emitting diodes.

3. An ice hockey puck according to claim 1, characterized in that the energizing source is a pulsing source.

4. An ice hockey puck according to claim 1, characterized in that the light source together with an energizing source and electrical or electronic switching or control means are disposed within a transparent housing occupying the recess.

5. An ice hockey puck according to claim 1, characterized in that the material occupying the light channels provides a transparent body having a cavity for receiving a light source.

6. An ice hockey puck according to claim 1, characterized in that the light emitting surface of the material in the light channels comprises lens-shaped or pyramid-shaped projections.

7. An ice hockey puck according to claim 1, characterized in that a magnetically operated on/off switch is provided between energy source and light source.

8. An ice hockey puck according to claim 4, characterized in that the transparent body is surrounded at the outside of its light emitting surface and the cavity region with a reflecting or fluorescent layer.

* * * * *